US006770142B2

(12) United States Patent
Estelle

(10) Patent No.: US 6,770,142 B2
(45) Date of Patent: Aug. 3, 2004

(54) MONITORING SYSTEM AND METHOD FOR FLUID DISPENSING SYSTEM

(75) Inventor: Peter W. Estelle, Norcross, GA (US)

(73) Assignee: Nordson Corporation, Westlake, OH (US)

( * ) Notice: Subject to any disclaimer, the term of this patent is extended or adjusted under 35 U.S.C. 154(b) by 201 days.

(21) Appl. No.: 10/039,411

(22) Filed: Oct. 29, 2001

(65) Prior Publication Data

US 2002/0079325 A1 Jun. 27, 2002

Related U.S. Application Data

(60) Provisional application No. 60/244,548, filed on Oct. 31, 2000.

(51) Int. Cl.[7] ..... B05C 11/10

(52) U.S. Cl. ..... 118/682; 118/702; 118/703; 118/708; 118/712; 156/356; 156/357; 156/366

(58) Field of Search ..... 118/679, 681, 118/682, 683, 684, 708, 712, 713, 696, 699, 702, 703; 156/356, 357, 366; 239/70

(56) References Cited

U.S. PATENT DOCUMENTS 4,957,782 A * 9/1990 Medler et al. ..... 427/421
5,026,989 A 6/1991 Merkel
5,540,946 A 7/1996 De Vries et al.
5,683,752 A * 11/1997 Popp et al. ..... 427/421
6,299,931 B1 * 10/2001 Leary et al. ..... 427/8

OTHER PUBLICATIONS

Nordson Corporation, *Seal Sentry™ Series 50 Seal Verification System*, Product Specification, Aug., 2001.

* cited by examiner

*Primary Examiner*—Richard Crispino
*Assistant Examiner*—George R. Koch, III
(74) *Attorney, Agent, or Firm*—Wood, Herron & Evans, L.L.P.

(57) ABSTRACT

An apparatus for monitoring an operation of a fluid dispensing gun dispensing a pattern of fluid onto a substrate moving with respect to the dispensing gun. The dispensing gun changes operating states in response to transition signals. A sensor is disposed adjacent the substrate and provides feedback signals in response to detecting edges of the fluid dispensed onto the substrate. A diagnostic monitor is responsive to the transition and feedback signals and automatically measures delays between occurrences of the transition signals and detecting corresponding edges of the fluid deposited onto the substrate resulting from the transition signals. The delays are measured by correlating the feedback signals to the transition signals. A method for measuring the delays is also described and claimed.

5 Claims, 3 Drawing Sheets

MONITORING SYSTEM AND METHOD FOR FLUID DISPENSING SYSTEM

This application claims the benefit of U.S. Provisional Application No. 60/244,548 entitled, "DIAGNOSTIC MONITORING SYSTEM FOR FLUID DISPENSING SYSTEM", filed on Oct. 31, 2000.

FIELD OF THE INVENTION

The present invention relates generally to fluid dispensing systems for dispensing flowable material, such as adhesives, sealants, caulks and the like, onto a substrate and, more particularly, to a system and method for monitoring the operation of a fluid dispensing system.

BACKGROUND OF THE INVENTION

The ability to precisely dispense a fluid, for example, an adhesive, is a necessity for manufacturers engaged in the packaging and plastics industries. A typical fluid dispensing operation employs a dispensing gun to apply the adhesive onto a substrate being moved past the dispensing gun, for example, by a conveyor. The speed of the conveyor, or line speed, is set according to such factors as the complexity of the dispensing pattern and the configuration of the gun. Adhesive is normally supplied to the dispensing gun under pressure by a motor driven pump.

The quality of the adhesive dispensing process is subject to many variables that include general environmental conditions, the physical state of the adhesive being dispensed, the physical condition of the dispensing apparatus and the stability of other system parameters, for example, the stability of the electrical parameters in the system. Changes in those variables often result in changes in actuation time of the dispensing gun. For example, if an electric dispensing gun is being used with an unregulated power source, fluctuations in line voltage alter the actuation time of the dispensing valve, that is, the time required to open and close the dispensing gun. An increase in line voltage results in the actuating time decreasing; the dispensing gun opening faster; and the adhesive flowing through the gun sooner than expected. Thus, the adhesive is deposited onto the substrate at a different location than anticipated. For example, upon receiving a part present signal, the gun may open so fast that the fluid is dispensed prior to the substrate reaching a position to receive the dispensed fluid. Thus, adhesive is dispensed at a location not intended to receive adhesive. A similar problem occurs if the dispensing gun experiences a drop in line voltage.

Changes in the voltage from an unregulated source may also impact the quality of the fluid dispensing process when the dispensing valve is commanded to close. Variations in gun actuation times are also caused by changes in the viscosity of the adhesive being dispensed. Heaters within the fluid dispensing system can malfunction, or heat can be transferred into, and retained by, the fluid dispensing gun in its normal operation. Either of those as well as other conditions can change the temperature of the adhesive, thereby changing its viscosity. Viscosity variations change the drag of the adhesive on the dispensing gun's armature and hence, the actuation times of the dispensing valve. As previously discussed, changes in the actuation time may result in the application of adhesive at undesirable locations on the substrate.

Variations in the operation of the dispensing gun also occur for other reasons. The mechanical wear and aging of components within the dispensing gun can impact gun actuation time. For example, a return spring is often used to move the dispensing valve in opposition to a solenoid. Over its life, the spring constant of the return spring changes, thereby changing the rate at which the dispensing valve opens and closes and hence, the location of dispensed adhesive on a substrate. Further, the accumulation of charred adhesive within the dispensing gun over its life often increases frictional forces on the dispensing valve, thereby changing gun actuation time. Thus, for the above and other reasons, the operation of the dispensing gun is subject to many changing physical forces and environmental conditions that cause variations in the actuation time of the dispensing gun. Such dispensing gun variations in opening and closing actuation times produce variations from desired locations of adhesive that are deposited onto a substrate.

There are known devices for detecting the quality of the adhesive dispensing process. Some systems attempt to monitor air bubbles and discontinuities in an adhesive bead within, or as the bead is being dispensed from, the dispensing gun. Other systems detect the presence of a bead and bead discontinuities with infrared or photoelectric sensors. Still other systems use lasers or photoelectric sensors to determine the height and/or cross-sectional area of the bead. Such systems detect physical characteristics of the dispensed adhesive bead on the substrate and hence, provide an indication of the quality of the adhesive dispensing process. While such systems effectively detect presence and size of a bead of adhesive, those systems are observing only one result of changes in the fundamental characteristics of the adhesive dispensing process.

Another system for testing for the quality of the adhesive dispensing process senses an edge of an adhesive bead within a programmed window within which the edge of the adhesive bead is predicted to occur. Such a system is a "SEAL SENTRY" monitoring system commercially available from Nordson Corporation of Duluth, Ga. By monitoring the sensed occurrences of adhesive bead edges within respective programmed windows of occurrences, the system detects bead presence and hence, provides an indicator of the quality of the adhesive dispensing process. This monitoring system requires that the adhesive pattern that is programmed into the pattern controller also be programmed into the monitoring system. Thus, the system requires a highly skilled technical person for a substantial period of time to perform the programming. Further, over a dispensing period, if the adhesive dispensing process experiences drift requiring an adjustment to the adhesive pattern in the pattern controller, it is easy to overlook the necessity of also changing the mirrored adhesive pattern in the monitoring system. Thus, this monitoring system is relatively complex, expensive and labor intensive in its programming and maintenance.

Therefore, there is a need for a monitoring system that effectively and reliably detects the quality of the dispensing process and is relatively easy for the user to setup, use and maintain.

SUMMARY OF THE INVENTION

The diagnostic monitor for a fluid dispensing system of the present invention permits the dispensing of adhesive onto a moving substrate to be accurately and continuously tracked. By accurately correlating the presence of adhesive on the substrate with dispensing command signals, a wide variety of statistical processing methods may be readily used as part of a quality control process. The diagnostic monitor of the present invention is easy to use, requires little user setup or maintenance and is very reliable. The diagnostic monitor of the present invention is especially useful in those adhesive dispensing applications in which complex patterns of adhesive are being dispensed. By automatically, accurately, reliably and continuously monitoring the adhesive dispensing process, the diagnostic monitor of the present invention provides more capability to measure the quality of the adhesive dispensing process. Therefore, the diagnostic monitor of the present invention increases yields and reduces scrap product and hence, reduces manufacturing costs and product unit cost.

In accordance with the principles of the present invention and the described embodiments, the invention in one embodiment provides an apparatus for monitoring an operation of a fluid dispensing gun dispensing a pattern of fluid onto a substrate moving with respect to the dispensing gun. The dispensing gun changes operating states in response to transition signals. A sensor is disposed adjacent the substrate and provides feedback signals in response to detecting edges of the fluid dispensed onto the substrate. A diagnostic monitor is responsive to the transition and feedback signals for automatically measuring delays between occurrences of the transition signals and detecting corresponding edges of the fluid deposited onto the substrate resulting from the transition signals.

In one aspect of the invention, the diagnostic monitor has a signal correlator for correlating the feedback signals to the transition signals to measure the delays.

In another embodiment of the invention, a method is provided that monitors an operation of a dispensing gun dispensing a pattern of fluid onto a substrate moving with respect to the dispensing gun. The dispensing gun turns ON and OFF in response to transition signals, and a sensor provides feedback signals representing detected edges of the fluid dispensed onto the substrate by an operation of the fluid dispensing gun. The delays between occurrences of the transition signals and detected corresponding edges of the fluid resulting from the transition signals are measured to provide an indication of quality of the dispensing process.

In one aspect of this invention, the method provides a signal representing a presence of the substrate in proximity to the dispensing gun. Next, the transition and feedback signals are periodically sampled and stored; and thereafter, the sampled feedback signals are correlated to the sampled transition signals.

Various additional advantages, objects and features of the invention will become more readily apparent to those of ordinary skill in the art upon consideration of the following detailed description of embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

The various embodiments of the diagnostic monitor of the present invention utilize a signal correlation process to determine delays between the occurrence of control signals commanding the dispensing gun to open and/or close and the occurrence of edges of material dispensed onto a moving substrate in response to the control signals. Statistical processing of the delays permits a monitoring of the quality of the material dispensing process.

Figure 1:
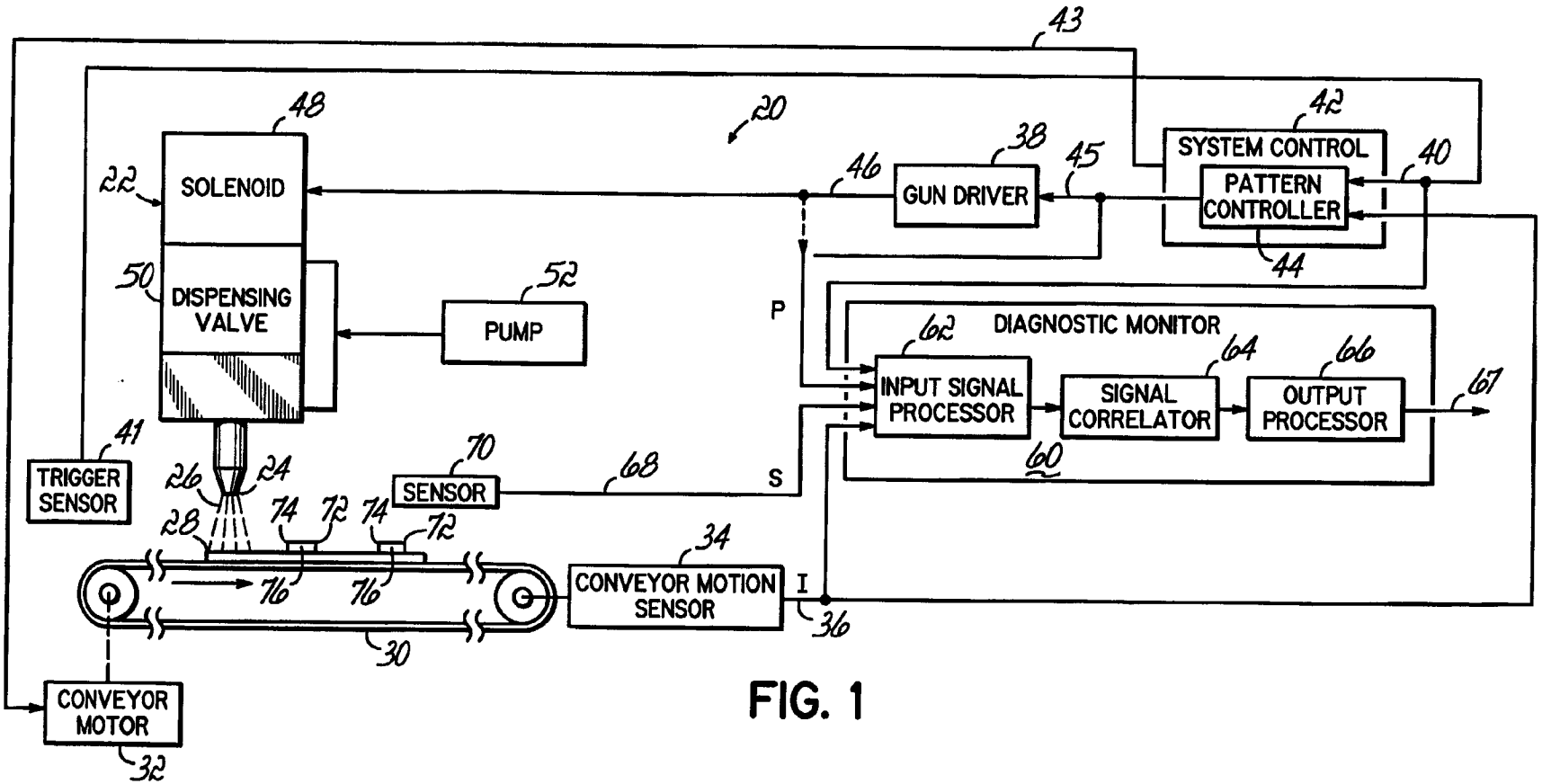
FIG. 1 is a schematic block diagram of a diagnostic monitor for use with a fluid dispensing system in accordance with the principles of the invention.

Referring to FIG. 1, a fluid dispensing system 20 is comprised of a fluid dispensing gun 22 having a nozzle 24 for dispensing a fluid 26, for example, an adhesive, onto a substrate 28. The substrate 28 is carried by a conveyor 30 past the dispensing gun 22. The conveyor 30 is mechanically coupled to a conveyor drive having a conveyor motor 32. Motion of the conveyor is detected by a conveyor motion sensor 34, for example, an encoder, resolver, etc., mechanically coupled to the conveyor 30. The motion sensor 34 has an output 36 providing a feedback signal that changes as a function of changes in the conveyor position.

A system control 42 generally functions to coordinate the operation of the overall fluid dispensing system. For example, the system control 42 normally provides a user interface for the system and controls the operation of the conveyor motor 32 via a signal line 43. Further, the system control 42 includes a pattern controller 44 that controls the operation of the fluid dispensing gun 22 as a function of a particular application being run. The pattern controller 44 receives, on an input 40, a part present or trigger signal from a trigger sensor 41. The trigger sensor 41 detects a feature, for example, a leading edge, of the substrate 28 and the trigger signal provides a synchronization with motion of the substrate 28 on the moving conveyor 30. In response to the trigger signal, the pattern controller 44 provides a sequence of transition signals, that is, gun ON/OFF signals, normally in the form of pulses to a gun controller or driver 38 via an input 45. In the described embodiment, each of the gun ON/OFF signals has leading and trailing edges representing desired changes in state of the operation of the dispensing gun. The leading edges initiate a gun ON or open operation, and the trailing edges initiate a gun OFF or close operation. Thus, the leading and trailing edges of the gun ON/OFF signal from the pattern controller 44 are transition signals representing transitions of the operating state of the dispensing gun.

The gun driver 38 provides command signals on an output 46 to operate the dispensing gun 22 as a function of the timing and duration of the gun ON/OFF pulses from the pattern controller 44. In response to a leading edge of a gun ON/OFF signal, the gun driver 38 provides a gun command that operates a solenoid 48 within the dispensing gun 22. In a known manner, the solenoid 48 is mechanically coupled to a dispensing valve 50 that is fluidly connected to a motor-driven pump 52; and the pump 52 receives fluid, for example, an adhesive, from a reservoir (not shown). Upon receiving a command signal from the gun driver 38, the solenoid 48 opens the dispensing valve 50. Pressurized adhesive in the dispensing gun 22 passes through the nozzle 24 and is deposited onto the substrate 28 as a bead 76. The dispensing valve 50 remains open for the duration of the gun ON/OFF pulse; and in response to the trailing edge of a gun ON/OFF pulse, the gun driver provides a command signal changing the state of the solenoid 48 to close the dispensing valve 50. In most applications, as the substrate 28 is moved past the dispensing gun 22, a plurality of gun ON/OFF pulses causes the gun driver 38 to rapidly open and close the dispensing valve 50 to deposit a plurality of beads, dots or spots of adhesive 76 at different locations on the substrate 28.

The fluid dispensing system 20 further includes a diagnostic monitor 60 having an input signal processor 62, a signal correlator 64 and an output processor 66. The diagnostic monitor provides data or signals on an output 67 representing delays from the occurrence of leading and trailing edges of the gun ON/OFF pulses and the time when leading and trailing edges 72, 74, respectively, of adhesive beads 76 are detected by a sensor 70. Thus, the delays are comprised of at least two time-based components. The first component is the time required to move a bead 76 from the beneath the nozzle 24 to a location where it can be detected by a sensor 70. The second component is the time required for the solenoid 48 to actuate the dispensing valve 50 in response to the gun ON/OFF pulse. That output data or signals representing the measured delays are used to continuously track the quality of the adhesive dispensing process.

The input signal processor 62 receives a reference signal P that is either the gun ON/OFF pulses on an output 45 of the pattern controller 44 or alternatively, the corresponding command signals produced on the output 46 by the gun driver 38. The choice of the particular reference signal to use is a design decision, and each signal has its advantages and disadvantages. For example, using the gun ON/OFF pulse from the pattern controller 44 has the advantage of being an easier signal to process in the diagnostic monitor 60. However, a potential disadvantage is that use of the gun ON/OFF pulses introduces a third component into the delay measured by the diagnostic monitor. That third component is the signal processing delay of the gun driver 38, which is typically a small and fixed delay. If one wishes to eliminate the delay introduced by the gun driver 38, as shown in phantom in FIG. 1, the input signal processor 62 can alternatively receive the command signals provided by the gun driver 38 on the output 46. However, the command signals require a more complex signal conditioning within the diagnostic monitor 60.

The input signal processor 62 also receives a feedback signal S on an output 68 of the sensor 70. The sensor 70 is mounted with respect to the conveyor 30 such that the sensor 70 can sense leading and trailing edges 72, 74, respectively, of the adhesive beads 76 as the substrate moves on the conveyor 30. The sensor 70 is any sensor capable of reliably detecting the leading and trailing edges 72, 74, respectively, for example, an infrared sensor, laser sensor, etc.

The input signal processor 62 also receives a conveyor feedback signal provided on the output 36 of the conveyor motion sensor 34. The conveyor feedback signal is processed to generate a sampling signal I that is used to initiate a sampling of the reference signals P and sensor feedback signals S. In the embodiment of FIG. 1, the sampling signal executes a spatial sampling, that is, a sampling that occurs over increments, for example, equal increments, of displacement of the substrate 28 past the sensor 70. Alternatively, the sampling signal used by the input signal processor 62 may be temporal in nature and derived from a timer within the diagnostic monitor 60 or elsewhere within the fluid dispensing system 20. With temporal sampling, the reference and feedback signals on lines 46, 68, respectively, are sampled over increments, for example, equal increments, of time. The input signal processor 62 samples over a period determined by the trigger signal on signal line 40.

Figure 2:
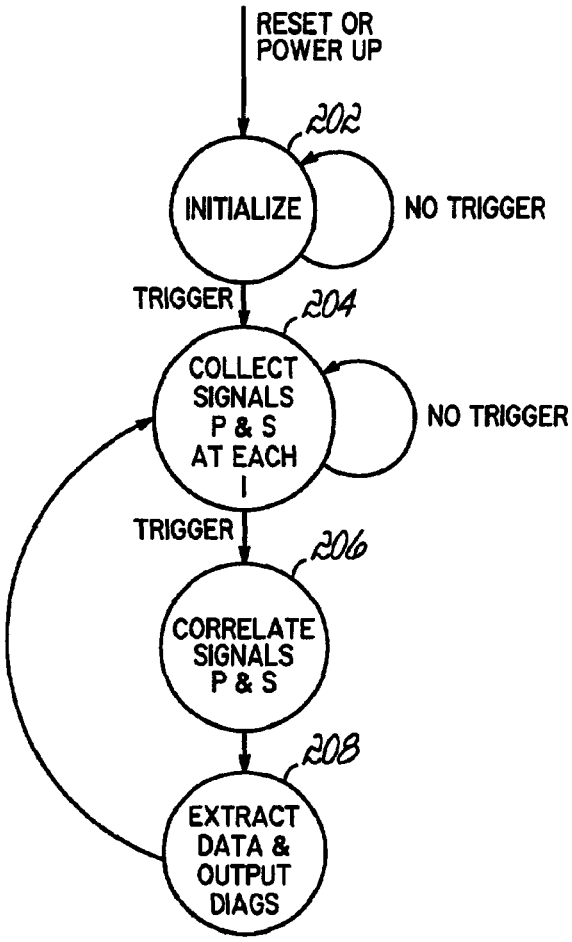
FIG. 2 is a state diagram of one embodiment of the diagnostic monitor of FIG. 1.

One embodiment of the operation of the diagnostic monitor 60 is shown in the state diagram of FIG. 2. Upon detecting a reset or power up, the diagnostic monitor 60 enters an initialize state 202 in which default and initialization parameters are established. The diagnostic monitor remains in the initialize state 202 as long as a trigger signal is not received by the pattern controller 44. Upon a trigger signal being detected by the diagnostic monitor 60, it switches to a collect signal state 204 in which reference or pattern signals P and sensor feedback signals S are sampled, collected and stored with each occurrence of the sampling signal I.

Figure 3:
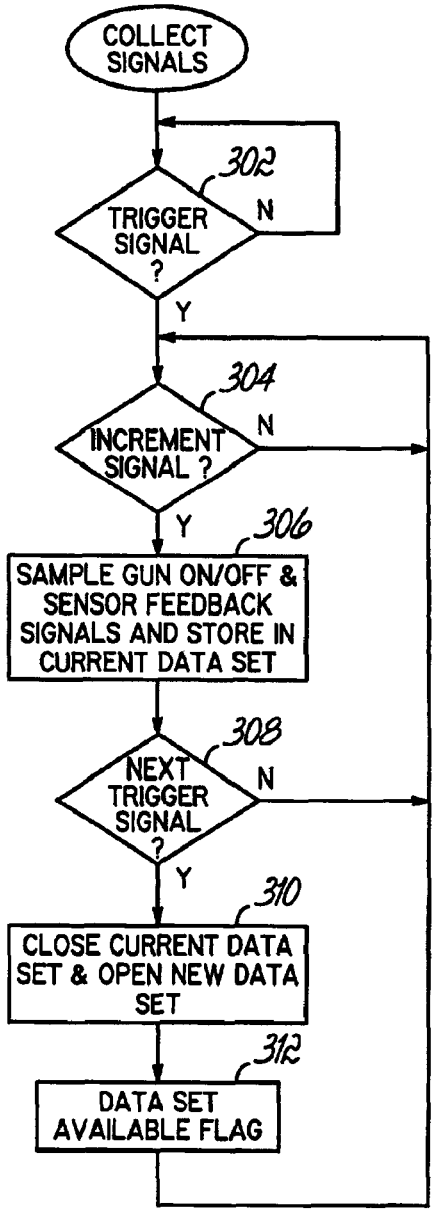
FIG. 3 is a flowchart of the signal collection process used by the diagnostic monitor of FIG. 1.

The process of collecting the P and S signals is illustrated in further detail in FIG. 3. The process or subroutine of FIG. 3 is initiated by the occurrence of a trigger signal that changes the state of the diagnostic monitor from the initialize state to the collect signal state. The occurrence of that first trigger signal is shown being detected at 302. Next, at 304, a determination is made whether a sampling period, that is, the time between the P and S signal samples has expired. As described earlier, the sampling period may be spatial or temporal. In FIG. 1, a spatial measurement is illustrated. Thus, the input signal processor monitors the feedback signal from the conveyor motion sensor 34 to determine a displacement or translation of the substrate 28 moving on the conveyor 30. The incremental displacement determining a sampling period is dependent on the application and the requirements of the signal correlator 66. At the end of a sampling period or interval, the input signal processor 62 generates a sampling signal I. Upon the sampling signal being detected at 304, the input signal processor 62, at 306, proceeds to sample both the gun ON/OFF pulse from the pattern controller 40 and the sensor feedback signal from the sensor 70. Those signals are stored together as a pair in a current data set.

The sampling process of steps 304, 306 continues until, at 308, the input signal processor 62 detects the occurrence of a subsequent trigger signal on the input 40 of the pattern controller 44. The frequency of the sampling process of steps 304, 306 is selected so that there are a sufficient number of data points in the data set to perform a desired signal correlation process in the signal correlator 64. The number of such sampled data points may be in the range of from approximately several hundred to approximately one thousand or more. Upon the diagnostic monitor detecting a successive trigger signal to the pattern controller 44, the input signal processor 62, at 310, closes the current data set and opens a new data set. In addition, at 312, the input signal processor 62 sets a data set available flag indicating that data is available for the execution of the correlation process.

Referring again to FIG. 2, upon the occurrence of the subsequent trigger signal and the setting of the data set available flag, the diagnostic monitor 60 switches from the collect signal state 204 to a correlate signal state 206. In the correlate signal state, the signal correlator 62 (FIG. 1) of the diagnostic monitor 60 performs a discrete spatial or temporal correlation depending on whether conveyor motion or internal timers are used to determine the sample periods. The following represents one correlation that may be performed.

$$C(k) = \sum_{n=1}^{N} p(n) * s(n+k)$$

Where:

C(k) is the correlation,

N is the number of points,

P(n) is a discrete time signal represented by the gun ON/OFF signal, and

S(n) is another discrete time signal represented by the sensor feedback signal.

The cross-correlation of two signals P(n) and S(n) may be calculated directly in the time domain as shown above using either hardware or software. However, this can be computationally intensive (especially in software). In that situation, the following relation can be used:

$$P(n) \text{ correlated with } S(n) __ P(w)^* S(-w)$$

Where:

__ denotes a Fourier transform pair, and

P(w) and S(w) are the spectra of the signals P(n) and S(n), respectively. Therefore, an alternative procedure is to use an FFT (Fast Fourier Transform) algorithm to compute the spectra of the two signals and then multiply one spectra by the conjugate of the other. The result of this operation is the cross-spectrum. Taking the inverse FFT of the cross-spectrum yields the cross-correlation.

In one embodiment that simplifies computation, the correlation process first identifies leading and trailing edges of gun ON/OFF signals, that is, transition signals commanding the dispensing gun to turn ON and OFF, respectively. Next, the first, narrow, fixed-width pulses are generated in response to the sampled transition signals. In addition, the second, narrow, fixed-width pulses are generated in response to identifying corresponding edges of adhesive from sampled feedback signals. The second, fixed-width pulses are correlated to the first, fixed-width pulses to produce measured delays between the occurrences of the transition signals and detecting corresponding edges of the dispensed adhesive resulting from the occurrences of the transition signals.

As will be appreciated by those who are skilled in the art, other issues relating to normalization, windowing, etc. must also be addressed. The result of the correlation is a series of numbers representing a sequence of measured delays between the P and S signals. At the end of the correlation process, a correlation done flag is set, and the diagnostic monitor 60 switches to an output state 208.

In the output state, the output processor 66 within the diagnostic monitor 60 detects the state of the correlation done flag and proceeds to process the resultant correlation data. First, delays between the occurrence of leading and trailing edges of the gun ON/OFF pulses and the time when leading and trailing edges 72, 74, respectively, of adhesive beads 76 are detected by a sensor 70 are extracted from the correlation. Next, the output processor 66 processes the extracted data. The processing of the correlation data is often user dependent; and therefore, the output process 66 may simply present the delays on an output 67 to a processing unit (not shown) of the user. In other situations, the output processor 66 may be programmed by the user to perform different processing techniques. For example, given a constant conveyor speed, one would expect that the determined delays would be relatively constant. Therefore, the output processor 66 may detect a substantial increase or decrease in any one of the delays determined by the signal correlator 64. Upon detecting a substantial increase or decrease, an alarm is presented to the user in the form of an audible sound, a light, a message display or other sensory perceptible presentation. In other applications, the output processor 66 may detect a drift in the adhesive dispensing process. Such a drift is reflected in the delays becoming incrementally smaller or larger over a period of time. The delays determined by the signal correlator 64 may be utilized to make plots that would demonstrate drift in a known manner.

In other applications, the output processor 66 may be programmed to average the delays computed from a single data set. In still further applications, the output processor 66 may average particular delays in one data set with respective delays in one or more subsequent data sets. An averaging process has the effect of filtering or minimizing variations in the computed delays due to transient conditions or noise.

It should be noted that in FIG. 2, the correlation state 206 is a separate state from the collect signal state 204. Depending on the adhesive dispensing application, the equipment used and the correlation technique implemented, the correlation state 206 may require a period of time that exceeds the time between trigger pulses. Assume, for example, that it requires a period of time in excess of the trigger period to perform the correlation process in the signal correlator 64. In that situation, correlation data is extracted and output in association with every other trigger signal. As will be appreciated, the correlation process does not have to occur with each trigger signal.

Figure 4:
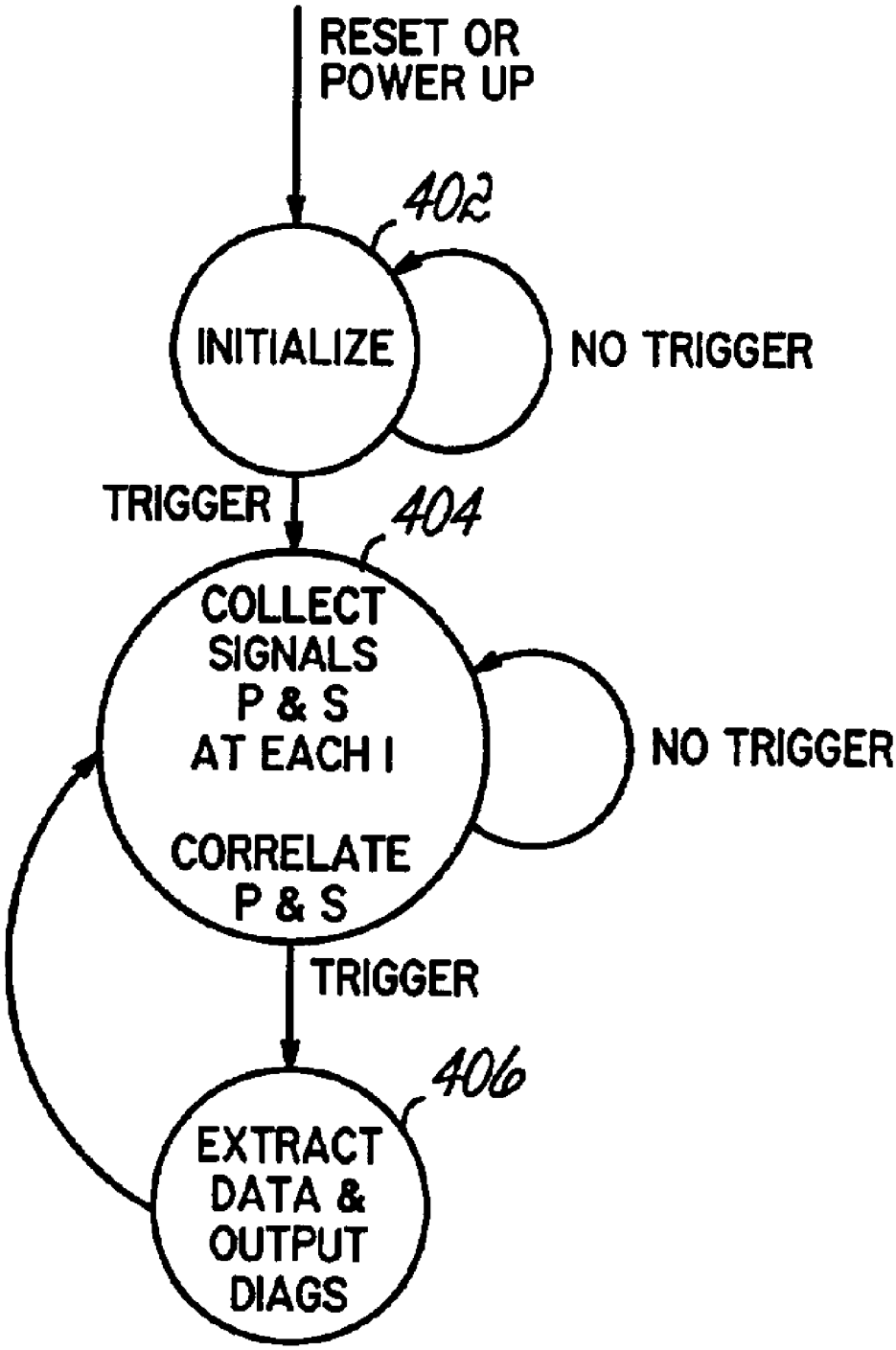
FIG. 4 is a state diagram of another embodiment of the diagnostic monitor of FIG. 1.

In some applications, the adhesive dispensing process and the correlation method permit the collection of signals and the subsequent correlation of those signals to occur within the time period of a single trigger signal. An example of such an operation is illustrated in FIG. 4. In a manner as previously described, upon a reset or power-on condition, the diagnostic monitor 60 enters an initialize state 402 awaiting the occurrence of a trigger signal. Upon sensing the trigger signal, the diagnostic monitor 60 switches to a collect signal and correlate state 404. In this state, the reference and sensor signals, P and S, respectively, are collected in a manner identical to that described with respect to state 204 of FIG. 2. After a sufficient number of samples of the P and S signals are detected and stored in a data set, for example, upon detecting a subsequent trigger signal, the signal correlator 64 immediately correlates the P and S signals within that data set. The nature of the adhesive dispensing application as well as the speed of the correlation process permits all of the data to be collected and the complete correlation process executed prior to the occurrence of a subsequent trigger signal. When that signal is detected, the diagnostic monitor 60 switches from state 404 to the output state 406. As previously described with respect to the output state 208 of FIG. 2, the delay data is extracted and output on line 67 of the diagnostic monitor 60. Alternatively, diagnostics may be computed from the delay data and output on line 67.

The diagnostic monitor 60 permits an accurate and continuous tracking of the dispensing of adhesive onto a moving substrate. By accurately correlating the occurrence of adhesive on the substrate with signals commanding the dispensing process, a wide variety of statistical processing methods may be used as part of a quality control process. Further, numerous real time quality control measurements are possible. Indications of the quality of the adhesive dispensing process can be found in looking at the distribution and/or magnitude of the measured delays. Variations in the delays are an indication of a difference in bead location from one part to another.

The diagnostic monitor 60 is easy to use, requires little user setup or maintenance and is very reliable. Further, the diagnostic monitor 60 is especially useful in those adhesive dispensing applications in which complex patterns of adhesive are being dispensed. By automatically, accurately, reliably and continuously monitoring the adhesive dispensing process, the diagnostic monitor 60 provides more data with which to measure the quality of the adhesive dispensing process. Therefore, the diagnostic monitor 60 increases yields and reduces scrap product, thereby reducing manufacturing costs and product unit cost.

While the present invention has been illustrated by a description of various embodiments and while these embodiments have been described in considerable detail, it is not intended to restrict or in any way limit the scope of the appended claims to such detail. Additional advantages and modifications will readily appear to those skilled in the art. For example, the diagnostic monitor 60 of the present invention can be used with solenoids 48 that are either pneumatic cylinders or electric coils. Further, the diagnostic monitor 60 can be implemented in hardware or software using digital, analog or a combination of digital and analog devices. Further the input signals to the diagnostic monitor 60 may be digital, analog or a combination of digital and analog signals. For example, the P reference signal from the pattern controller 44 may be a digital signal, and the S signal from the sensor 74 may be an analog signal.

In the described embodiment, delays are measured for the gun ON transition edges and the gun OFF transition edges of the gun ON/OFF signals. While such a system provides a comprehensive monitoring system, as will be appreciated, lesser monitoring systems may also be implemented. For example, the present invention may be used to measure delays with respect to only the gun ON transitions, or alternatively, only the gun OFF transitions. Further, the delays may be measured with respect to every gun ON and/or gun OFF transition or measured with respect to gun ON and/or gun OFF transitions that are periodically selected.

The invention in its broader aspects is therefore not limited to the specific details, representative apparatus and method, and illustrative example shown and described. Accordingly, departures may be made from such details without departing from the spirit or scope of the general inventive concept.

What is claimed is:

1. An apparatus for monitoring an operation of a fluid dispensing gun dispensing a pattern of fluid onto a substrate moving with respect to the dispensing gun, the dispensing gun changing operating states in response to reference signals, and a sensor disposed adjacent the substrate for providing feedback signals in response to detecting edges of fluid on the substrate, the apparatus comprising:

a trigger sensor providing a transition signal representing a detected characteristic of the substrate moving with respect to the dispensing gun;

an input signal configure to be processor responsive to the transition signal, the reference signals and the feedback signals, said input signal processor periodically sampling a reference signal and providing a first representation of an edge of the reference signal, sampling a feedback signal and providing a second representation of a corresponding edge of fluid dispensed on the substrate resulting from an edge of the reference signal, and storing the first and the second representations;

signal correlator means configure to be responsive to the first and the second representations for correlating the second representation to the first representation; and an output processor configure to be responsive to said signal correlator means for extracting a delay between the edge of the reference signal and the corresponding edge of the fluid dispensed on the substrate resulting from an edge of the reference signal.

2. An apparatus for monitoring an operation of a fluid dispensing gun dispensing a pattern of fluid onto a substrate moving with respect to the dispensing gun, the dispensing gun changing operating states in response to reference signals, the apparatus comprising:

a first sensor disposed adjacent the substrate for providing feedback signals in response to detecting edges of fluid on the substrate;

a trigger sensor providing a transition signal representing a detected characteristic of the substrate moving with respect to the dispensing gun;

an input signal processor configured to be responsive to the transition signal, the reference signals and the feedback signals, said input signal processor periodically sampling a reference signal and providing a first representation of an edge of the reference signal, sampling a feedback signal and providing a second representation of a corresponding edge of fluid dispensed on the substrate resulting from an edge of the reference signal, and storing the first and the second representations;

signal correlator means configured to be responsive to the first and the second representations for correlating the second representation to the first representation; and an output processor configured to be responsive to said signal correlator means for extracting a delay between the edge of the reference signal and the corresponding edge of the fluid dispensed on the substrate resulting from an edge of the reference signal.

3. An apparatus for monitoring an operation of a dispensing gun dispensing a pattern of adhesive onto a substrate moving with respect to the dispensing gun, the apparatus comprising:

a pattern controller providing reference signals representing changes of state of operation of the dispensing gun;

a gun driver operatively connected to the dispensing gun and changing operating slates of the dispensing gun in response to said reference signals;

a first sensor disposed adjacent the substrate, said first sensor providing feedback signals in response to detecting edges of adhesive on the substrate;

a trigger sensor providing a transition signal representing a detected characteristic of the substrate moving with respect to the dispensing gun;

an input signal processor configured to be responsive to the transition signal, the reference signals and the feedback signals, said input signal processor periodically sampling a reference signal and providing a first representation of an edge of the reference signal, sampling a feedback signal and providing a second representation of a corresponding edge of fluid dispensed on the substrate resulting from an edge of the reference signal, and storing the first and the second representations;

signal correlator means configured to be responsive to the first and the second representations for correlating the second representation to the first representation; and an output processor configured to be responsive to said signal correlator means for extracting a delay between the edge of the reference signal and the corresponding edge of the fluid dispensed on the substrate resulting from an edge of the reference signal.

4. An apparatus for monitoring an operation of a dispensing gun dispensing a pattern of adhesive onto a substrate moving with respect to the dispensing gun, the apparatus comprising:

a pattern controller providing first reference signals representing changes of state of operation of the dispensing gun;

a gun driver providing second reference signals to the dispensing gun in response to said first reference signals, said second reference signals causing the dispensing gun to change operating states;

a first sensor disposed adjacent the substrate, said first sensor providing feedback signals in response to detecting edges of adhesive on the substrate;

a trigger sensor providing a transition signal representing a detected characteristic of the substrate moving with respect to the dispensing gun;

an input signal processor configured to be responsive to the transition signal, the second reference signals and the feedback signals, said input signal processor periodically sampling a second reference signal and providing a first representation of an edge of the reference signal, sampling a feedback signal and providing a second representation of a corresponding edge of fluid dispensed on the substrate resulting from an edge of the second reference signal, and storing the first and the second representations;

signal correlator means configured to be responsive to said signal correlator means representations for correlating the second representation to the first representation; and an output processor configured to be responsive to said signal correlator means for extracting a delay between the edge of the second reference signal and the corresponding edge of the fluid dispensed on the substrate resulting from an edge of the second reference signal.

5. An apparatus for monitoring an operation of a dispensing gun dispensing a pattern of adhesive onto a substrate moving with respect to the dispensing gun, the apparatus comprising:

a pattern controller providing gun ON and OFF signals representing times at which the dispensing gun should open and close, respectively;

a gun driver operatively connected to the dispensing gun and opening and closing the dispensing gun in response to said gun ON and OFF signals, respectively;

a first sensor disposed adjacent the substrate, said first sensor providing feedback signals in response to detecting edges of the adhesive on the substrate;

a trigger sensor providing a transition signal representing a detected characteristic of the substrate moving with respect to the dispensing gun;

an input signal processor configured to be responsive to the transition signal, the ON and OFF signals and the feedback signals, said input signal processor periodically sampling an ON and OFF signal and providing a first representation of an edge of the reference signal, sampling a feedback signal and providing a second representation of a corresponding edge of fluid dispensed on the substrate resulting from an edge of the ON and OFF signal, and storing the first and second representations;

signal correlator means configured to be responsive to the first and the second representations for correlating the second representation to the first representation; and an output processor configured to be responsive to said signal correlator means for extracting a delay between the edge of the ON and OFF signal and the corresponding edge of the fluid dispensed on the substrate resulting from an edge of the reference signal occurring.

* * * * *

UNITED STATES PATENT AND TRADEMARK OFFICE

CERTIFICATE OF CORRECTION

PATENT NO. : 6,770,142 B2
DATED : August 3, 2004
INVENTOR(S) : Peter W. Estelle

It is certified that error appears in the above-identified patent and that said Letters Patent is hereby corrected as shown below:

Column 9,
Line 5, change "configure" to -- configured --.
Line 30, insert -- the -- after "and".
Line 38, change "said signal correlator means" to -- the first and the second --.
Line 59, change "configure to be processor" to -- processor configured to be --.

Signed and Sealed this

Third Day of May, 2005

JON W. DUDAS
*Director of the United States Patent and Trademark Office*